United States Patent [19]

Wilson et al.

[11] 4,425,068

[45] Jan. 10, 1984

[54] BUNDLE FORMER FOR PAPERBOARD BOXES

[75] Inventors: Evearist B. Wilson, Hagerstown; Meyer L. Ruthenberg, Owings Mills, both of Md.

[73] Assignee: Koppers Company, Inc., Pittsburgh, Pa.

[21] Appl. No.: 292,219

[22] Filed: Aug. 10, 1981

[51] Int. Cl.[3] ..... B65H 31/34; B65G 57/30

[52] U.S. Cl. ..... 414/36; 271/179; 271/212; 271/314; 414/92; 414/94

[58] Field of Search ..... 414/36, 92, 93, 94; 271/179, 212, 314

[56] References Cited

U.S. PATENT DOCUMENTS

| | | | |
|---|---|---|---|
| 2,954,133 | 9/1960 | Geisow | 414/93 |
| 3,063,577 | 11/1962 | Shields | 414/94 X |
| 3,601,265 | 8/1971 | Shields | 271/212 X |
| 4,067,568 | 1/1978 | Irvine | 271/212 X |

OTHER PUBLICATIONS

IBM Technical Disclosure Bulletin, vol. 15, No. 7, Dec. 1972; "Document Exit Tray".

*Primary Examiner*—Leslie J. Paperner

*Attorney, Agent, or Firm*—Thomas L. Sivak; Herbert J. Zeh, Jr.

[57] ABSTRACT

An improved bundle former for corrugated paperboard boxes in which the timing of the lift mechanisms and the squaring plates is completely independent of the timing of the flexo-folder-gluer. Also, the stacking belt drive roll is mounted near the pull roll so its top periphery is below the path of box travel. This permits the folded box to contact the stacking belt tangentially, thereby easing the box's entry into the stacking station and providing an assist in squaring the box in the stack. The improved bundle former also includes simpler and more easily maintained elements.

3 Claims, 5 Drawing Figures

BUNDLE FORMER FOR PAPERBOARD BOXES

BACKGROUND OF THE INVENTION

1. Field of the Invention

The present invention relates to apparatus for counting, stacking and squaring bundles of flat articles, and more particularly, to apparatus for counting, stacking and squaring folded corrugated paperboard boxes.

2. Description of the Prior Art

Bundle formers for paperboard boxes are often referred to in the art as understackers because as the boxes leave the folder portion of the flexo-folder-gluer they enter the bundle former beneath the preceding box and form the stack from the bottom. These apparatus have been used for years in the box industry to form square stacks of folded boxes. However, in the prior art bundle formers have necessarily been complicated in that they included numerous gears, chains and sprockets and the lubricating and maintenance problems asociated with them. Also, in the prior designs the timing of the drive belt, lifting mechanism and squaring plate of the bundle former must be coordinated with the flexo-folder-gluer. Loss of coordination can cause jams of box blanks which require that the flexo-folder-gluer and stacker to be shut down with the attendant losses resulting from the down time.

The present invention overcomes the foregoing problems of the prior art by providing a bundle former having a simple and reliable drive mechanism. Further, the timing of the drive belt, lifting mechanism and squaring plate does not have to be sequenced with the timing of the flexo-folder-gluer.

SUMMARY OF THE INVENTION

The bundle former of the present invention is comprised of the necessary frame to mount the drive means for the stacking belt, pull rolls, squaring mechanism, and lift mechanism. Also mounted on the frame is the kicker assembly, the constant speed drive for the bundle take-off mechanism and the overhead compression member of the take-off mechanism and the other elements which comprise the subject invention.

The upper and lower pull rolls which receive the box blanks from the folder of the flexo-folder-gluer are both driven by a belt drive at a common rotational speed; however, the collar of the upper rolls is larger in diameter than that of the lower rolls. The box, after leaving the nip of the pull rolls, enters the stacking station by means of the stacking belt which it contacts tangentially by reason of a vee entryway. The combination of the difference in r.p.m.s of the pull rolls and the tangential contact of the box blank with the stacking belt provides an effect which helps shift the box blank into squareness. Squareness is insured by the squaring mechanism driven by eccentric shafts which oscillate at a frequency greater than the frequency of box entry into the stack. The box blanks are forced into contact with the backstop and lifting lobes by the stacking belt drive roll, pull rolls and squaring mechanism utilizing timing belts and pulleys which eliminate all gears, chains and sprockets. The lifting mechanism which raises the trailing edge of the blank to facilitate entry of the following blank into the stack is untimed with relation to the speed of the flexo-folder-gluer. The particular design of the lifting mechanism is an helicoidal surface having a rotational frequency greater than the frequency of the box entry into the stacking section; thus, exact timing coordination between the bundler and flexo-folder-gluer is eliminated.

As described above, a box blank enters the stacking station beneath the preceding blank. As the stack increases in height, it is maintained in compression by means of a pressure weight mounted slidably on the frame. A counter assembly activates the kicker assembly when a predetermined number of boxes have entered the stacking station and the kicker assembly causes the stack to be transferred to the take-off conveyor where it is kept in compression. The transfer of piles is accomplished by the subsequent ejection of piles onto the compression section of the bundle former.

DESCRIPTION OF THE PREFERRED EMBODIMENT

Figure 1:
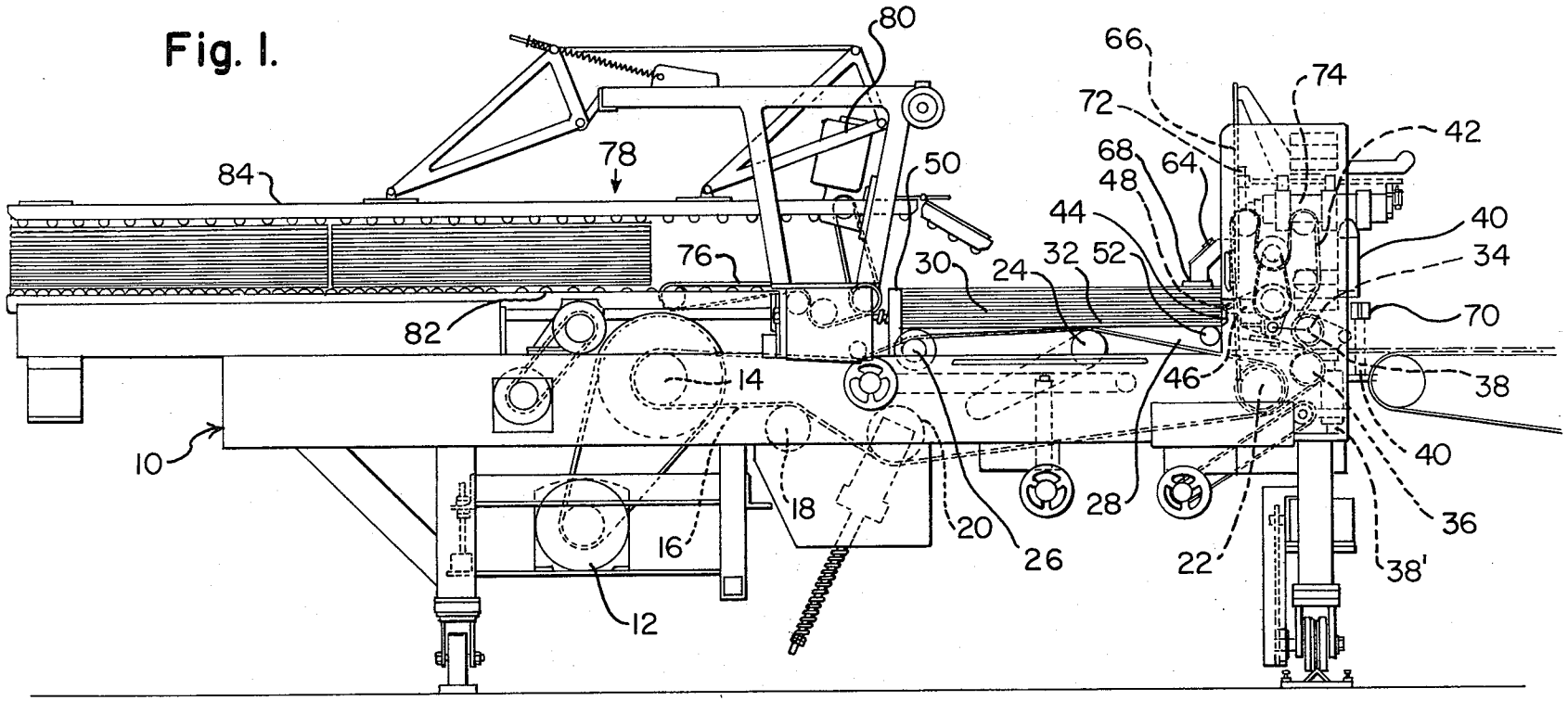
FIG. 1 is a side elevational view of the bundle former of the present invention.

Referring to the drawings, the frame of the bundle former is generally designated as 10, and as disclosed above, the frames serves as support for the elements of the present invention. Mounted on frame 10 in a conventional manner is a motor 12 and roll 14 through which stacking belt 16 is driven over pulleys 18, 20, drive roll 22, hump roll 24 and lifting lobes 26. Stacking belt 16 forms an entry vee 28 for the boxes, generally 30, at the entrance of the stacking station 32.

Figure 2:
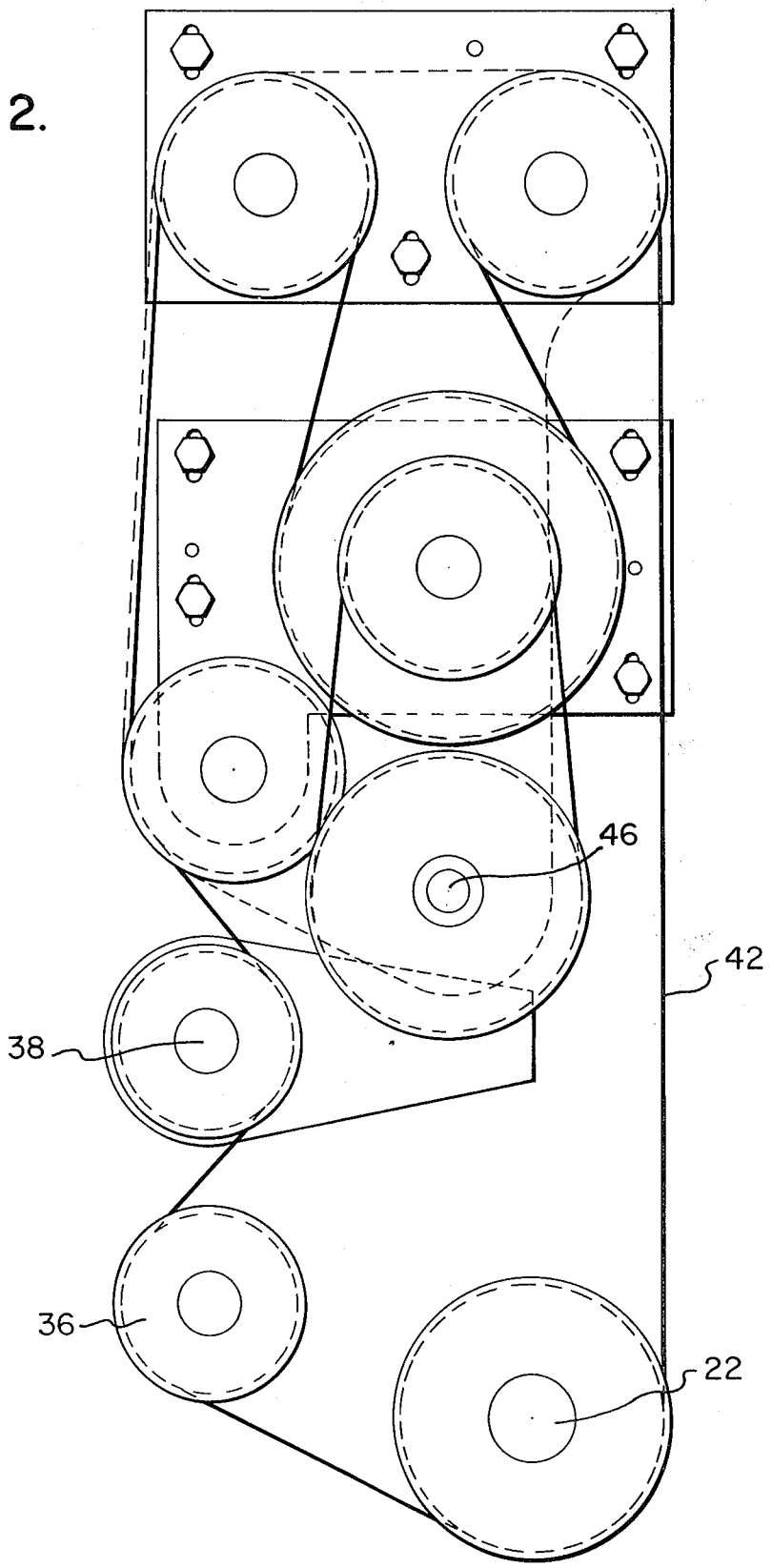
FIG. 2 is an exploded, elevational view of the belt drive system of the present invention.
Figure 3:
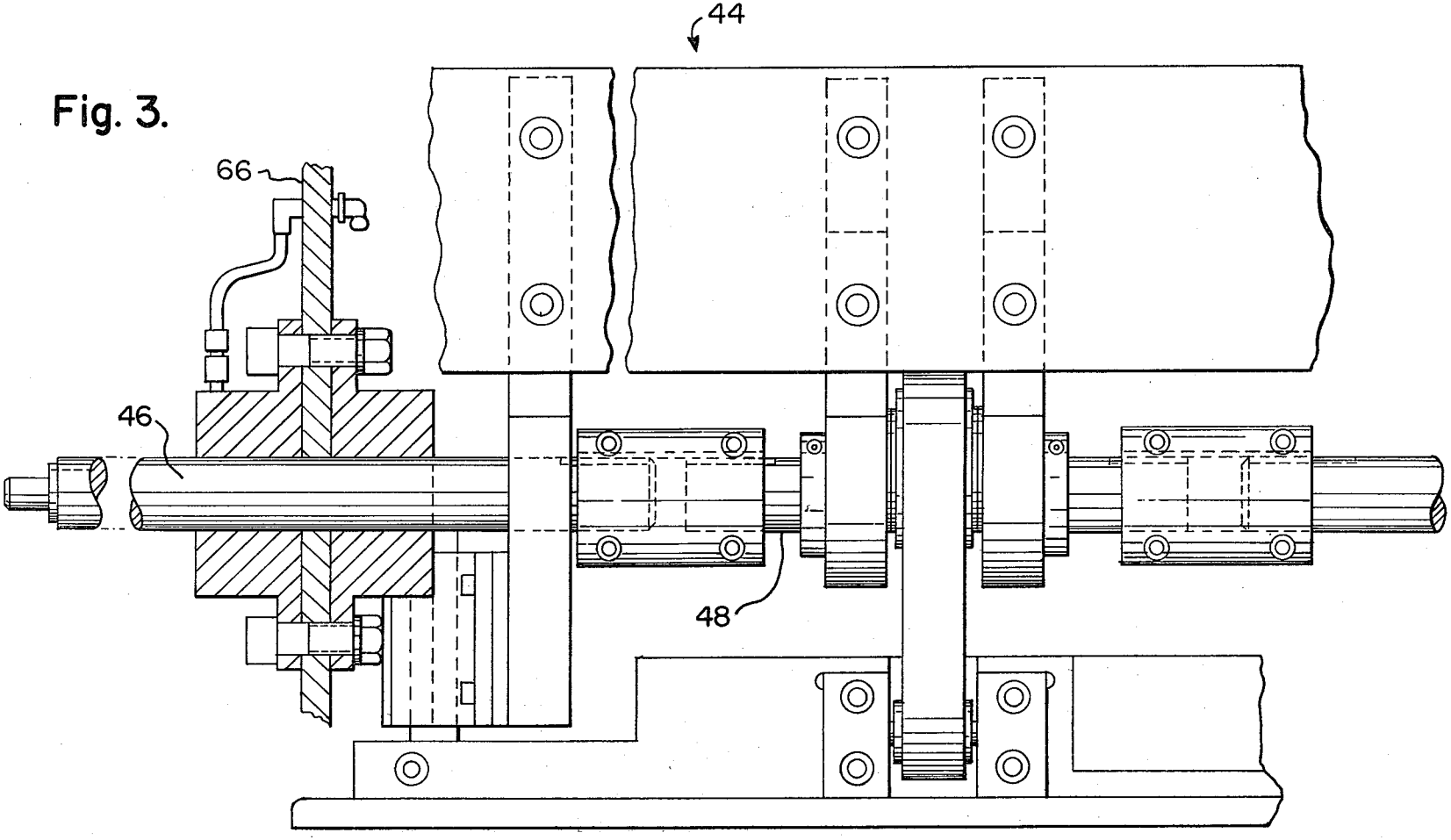
FIG. 3 is a sectional view in detail of the drive for the squaring mechanism of the present invention.

Upper pull collars 34 and lower pull roll 36 receive the box 30 from the folder unit of the flexo-folder-gluer. Collar 34 are mounted on shaft 38 on air pivoted cylinders 40 which permit them to be rotated from position in the event a jam of boxes occurs. The size of the nip between collar 34 and pull roll 36 can be adjusted by means of caliper screw adjustment 38' which controls the position of shaft 38. Collar 34 and pull roll 36 are driven off drive roll 22 by means of belt 42 which also drives the squaring mechanism 44 through shaft 46. The specifics of the preferred embodiment of the drive system are shown in FIG. 2. Once a blank enters the nip of collar 34 and pull roll 36, it is delivered into the entry vee 28 of the stacking station 32 where it can tangentially contact stacking belt 16 and is carried over hump roll 24 and onto lifting lobes 26. Collar 34 is larger in diameter than pull roll 36, and since they are both driven at common rotational speed by belt 42, the overspeed of pull roll collar 34 applies a motion to the box blank which, coupled with the contact of the blank against the underside of the preceding box, shifts the box into squareness. The squaring assembly 44 driven by shaft 46 through eccentric shaft 48 forces the box against backstop 50 to insure squareness. Details of the drive of the squaring assembly are shown in FIG. 3.

Once the box has entered the stacking station, the trailing edge contacts in operable contact with the disk-lift 52. Each disk supports the trailing edge of the box on its chordal dimension and is designed with a 90° peripheral break into a helix for lifting of the box edge.

Figure 4:
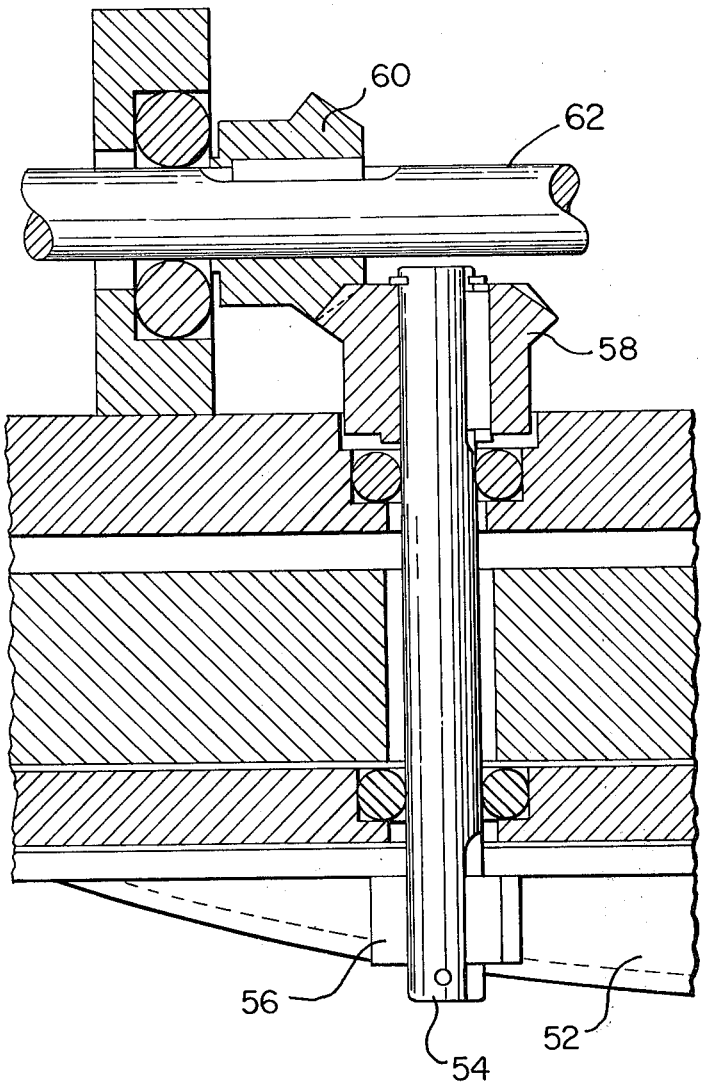
FIG. 4 is a side view in section of the drive mechanism for the disk-lifts of the present invention.
Figure 5:
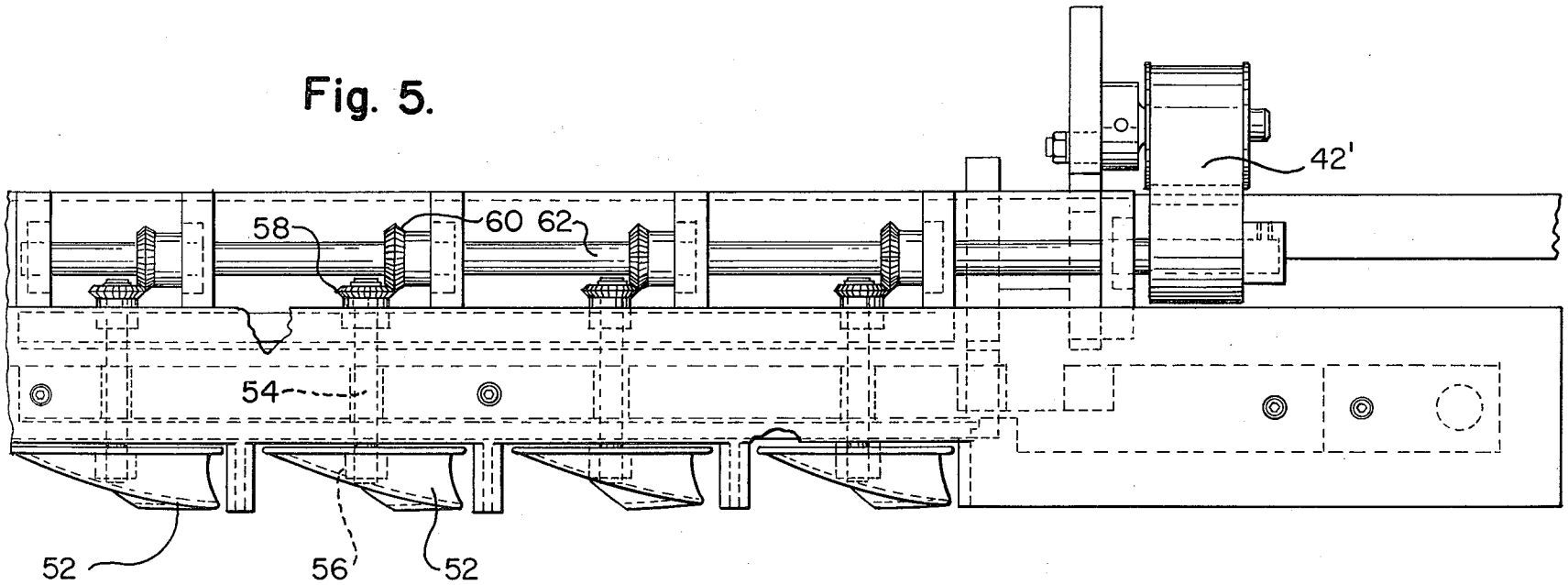
FIG. 5 is a front view in section of the drive mechanism for the disk-lifts of the present invention.

In the preferred embodiment, four disk elements are used as lifters. Referring to FIGS. 4 and 5, the disk lifters are an helicoidal surface mounted on shafts 54 by means of clamp 56. The disk elements 52 are driven through gears 58 and 60. Gear 60 is rotated by belt 42' through shaft 62. Belt 42' is driven through eccentric shaft 48, FIG. 3. The disk elements have a rotational frequency greater than the frequency of box entry into the stacking station. Therefore, the rotational frequency does not require exact timing coordination with the rate of box entry as in prior art designs.

The boxes in stacking station 32 are supported by lifting lobes 26, and lifting disks 52. Referring to FIG. 1, the lobes are held in compression in the stacking station by means of pressure weights 64 which are slideable over vertical guide bars 66. The spring fingers 68 of the pressure weights 64 are located above the trailing edge of the box stack to stabilize and dampen its movement as the stack grows in height.

Counter 70, which is a conventional numerical counter, counts the number of boxes entering into the stacking station 32. One a predetermined number is reached, counter 70, through a conventional electric circuit, activates air cylinder 74, which causes kicker 72, FIG. 1, to push the stack of boxes onto the transfer belts 76 in compression station 78. Constant speed motor 80 drives transfer belts 76 in compression station 78. Constant speed motor 80 drives transfer belts 76 at a speed which is coordinated with that of kicker 72. When a stack of boxes is placed on flow track conveyor 82 through the action of kicker 72 and transfer belts 76, it is held in compression by compression member 84. Compression member 84 is designed to keep the stack of boxes in compression the entire length of conveyor 82 which provides an increased compression time and assures proper glue setting. It is obvious that as additional stacks are deposited on conveyor 82, the preceding stack is moved forward by the next stack along the conveyor.

While we have described a certain preferred embodiment of our invention, it will be understood it may otherwise be embodied within the scope of the following claims.

What is claimed:

1. In a bundle former for counting and stacking folded paperboard boxes received from the flexo-folder-gluer comprising a frame on which are mounted upper and lower pull rolls for receiving said boxes, drive means for said pull rolls and belt, backstop, squaring means and stack removal means, said belt, backstop and squaring means forming a stacking station and transfer means to receive the stacks of boxes from the stacking station, the improvements comprising:

(a) the collar of said upper pull roll which operably engages the drive means being larger in diameter than the collar of said lower pull roll whereby said upper and lower pull rolls urge said blank into frictional contact with a preceding blank to urge said blank into squareness with said preceding blank;

(b) a plurality of lift means and drive means therefore mounted in said stacking station adapted to receive the trailing edge of said boxes entering the stacking station, said drive means adapted to rotate said lift means at a speed greater than the rate of entry of said boxes in said stacking station.

2. The bundle former of claim 1 wherein the drive roll of the drive means for the stacking belt is rotably mounted on said frame near said pull rolls below the path of said boxes passing through said pull rolls.

3. The bundle former of claim 1 wherein said lift means form a helicoidal surface having an outer edge in the shape of a helix to support said boxes.

* * * * *